US005345794A

United States Patent [19]

Jenks

[11] Patent Number: 5,345,794

[45] Date of Patent: Sep. 13, 1994

[54] SHACKLELESS PADLOCK SYSTEM

[76] Inventor: Bruce Jenks, 2279 Colgate Dr., Costa Mesa, Calif. 92626

[21] Appl. No.: 107,535

[22] Filed: Aug. 17, 1993

[51] Int. Cl.[5] ..... E05B 65/48

[52] U.S. Cl. ..... 70/14; 70/32; 70/370; 70/417

[58] Field of Search ..... 70/2-14, 70/23, 32-34, 51, 52, 54-56, 366, 370, 371, 416, 417, 451, 453, 466

[56] References Cited

U.S. PATENT DOCUMENTS

| | | | |
|---|---|---|---|
| 924,331 | 6/1909 | Fedla | 70/14 X |
| 1,969,011 | 8/1934 | Jacobi | 70/370 X |
| 3,316,742 | 5/1967 | Wellerens | 70/371 X |
| 3,769,821 | 11/1973 | Randel | 70/33 |
| 4,009,599 | 3/1977 | Patriquin | 70/371 X |
| 4,345,448 | 8/1982 | Solomon | 70/6 X |
| 4,347,720 | 9/1982 | Kenyon | 70/14 |
| 4,380,915 | 4/1983 | Kincaid et al. | 70/370 X |
| 4,565,080 | 1/1986 | Kincaid et al. | 70/370 X |
| 4,704,880 | 11/1987 | Schlindwein | 70/371 X |
| 4,754,626 | 7/1988 | Siegel | 70/51 X |
| 4,813,250 | 3/1989 | Yeh | 70/451 X |
| 4,838,055 | 6/1989 | Gallagher | 70/208 |
| 5,127,244 | 7/1992 | Myers | 70/2 |

FOREIGN PATENT DOCUMENTS

| | | | |
|---|---|---|---|
| 442788 | 11/1948 | Italy | 70/33 |

*Primary Examiner*—Peter M. Cuomo
*Assistant Examiner*—Suzanne L. Dino
*Attorney, Agent, or Firm*—Walter A. Hackler

[57] ABSTRACT

A shackleless padlock system is provided which includes a lock mechanism having a cylindrical body both protruding from one end thereof with a key-operating locking pin which retractably protrudes from the lock mechanism from a first to a second position for selectively engaging portions of a padlock body in order to either provide bolt engagement with the pad-lock body or for guiding a lock mechanism within the padlock body. Access to the locking pin in order that the lock mechanism may easily be removed and replaced with a different lock mechanism.

12 Claims, 2 Drawing Sheets

FIG. 1.
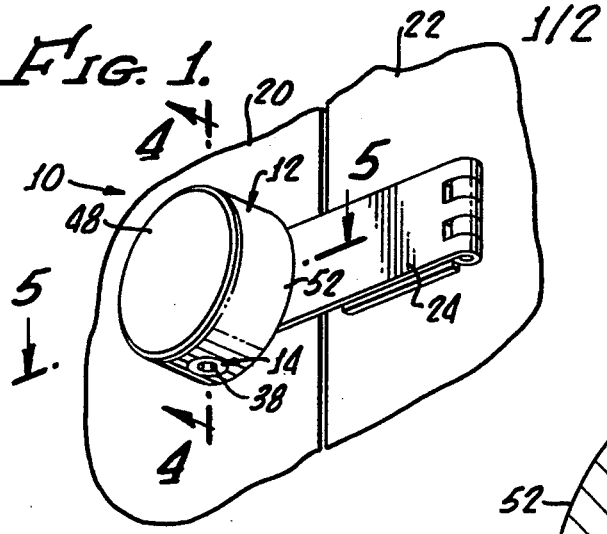
FIG. 3.
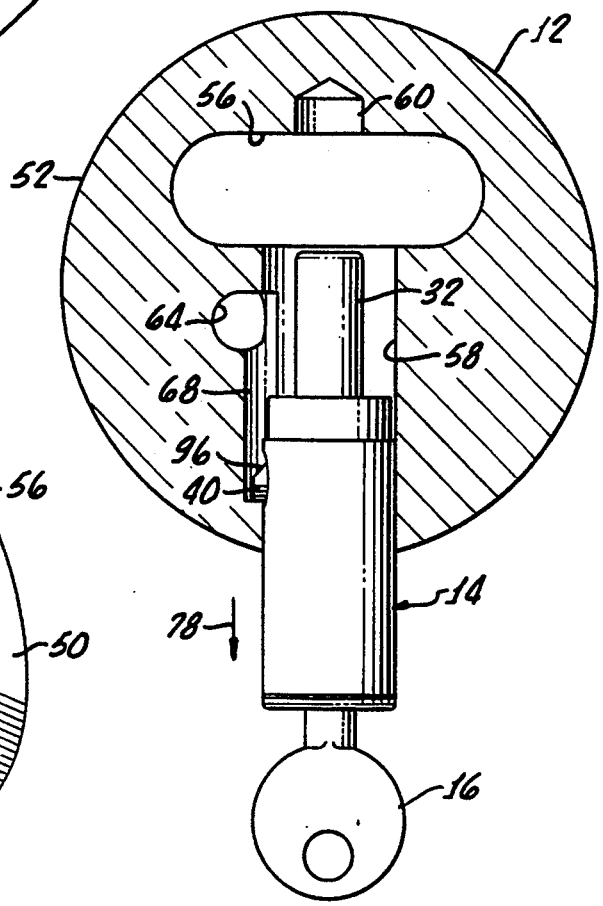
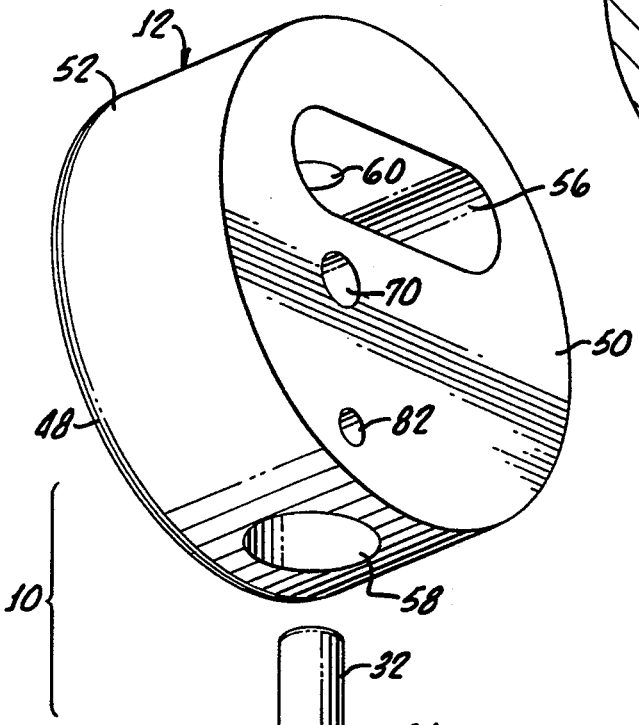
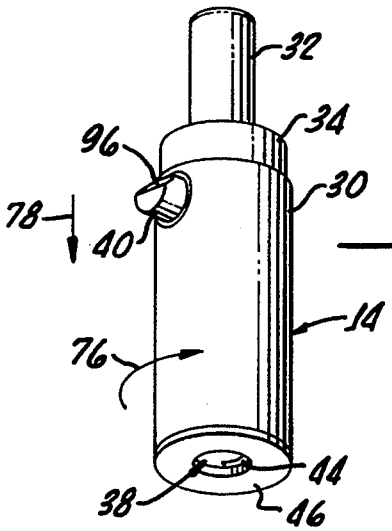
FIG. 2.

SHACKLELESS PADLOCK SYSTEM

The present invention generally relates to key locks, more specifically related to padlock devices and most particularly directed to improved construction for shackleless padlocks.

A specific limitation to the security offered a conventional padlock and hasp system arises from the fact that the padlock may be easily removed from the hasp, or the hasp itself severed by readily available bolt cutters. Thus, in less time than it takes to operate a combination-type lock, or insert a key into a key lock mechanism, the padlock may be removed with a pair of bolt cutters.

To overcome this limitation, shackleless padlocks have been developed to enhance the security of hasp/lock systems. Such shackleless locks are described in U.S. Pat. No. 3,769,821 and U.S. Pat. No. 5,127,244. As illustrated in these patents, the shackleless lock is used with a hasp-type arrangement on a door in which conventional bolt cutters are to no avail. The hasp is entirely covered by a shackleless padlock body and the hasp is held to the shackleless body in a sufficiently abutting relationship to prevent access to the hasp body by bolt cutters.

Shackleless locks, as generally described in U.S. Pat. No. 3,769,821, utilize the rotation of a shaped hand-like bolt by a key mechanism in order to effect locking of the shackleless padlock system. As pointed out in U.S. Pat. No. 5,127,244, difficulty is encountered with aligning the lock bolt and passing it through the hasp staple. In addition, prior art locks typically provide for manually sliding movement of the lock plug and lock bolt with the use of a key to engage or subsequently disengage the hasp staple.

Other disadvantages in the prior art shackleless padlock systems are the difficulty in the manufacture thereof, which typically involves the machining of a block of a metal to a specific configuration to handle lock mechanisms. In addition, re-keying of the prior art padlock systems requires a total disassembly of the lock system.

Such disassembly and re-keying is only possible through the services of a skilled locksmith.

The present invention overcomes the disadvantages of the prior art and provides for a shackleless padlock system which is easy to manufacture and further enables a layman to change the lock mechanism configuration without the use of any special tools or extensive locksmith knowledge.

SUMMARY OF THE INVENTION

A shackleless padlock system in accordance with the present invention for use in locking conventional hasp members includes one or more lock mechanisms, each having a cylindrical body and a bolt protruding from one end thereof, along with key operated means, disposed within the cylindrical body for causing a spring biased locking pin to retractably protrude from the cylindrical body. Manipulation of the key changes the protrusion of the spring biased locking pin from a first protruding position to a second protruding position.

An opening on another end of the cylindrical body provides means for accepting a key and providing access for the key to the key operated means.

As will be hereinafter described in greater detail, the spring biased locking pin is not retracted by the key mechanism to a position totally within or flush to the cylindrical body in order to provide a means for preventing unwanted disassembly of the lock mechanism from a padlock body and guidance of the lock mechanism within a padlock body.

The padlock body, in accordance with the present invention, includes back and front sides which subtend a connecting surface, and means are provided which define a slotted recess in the back side for receiving a hasp member. The padlock body further includes means defining a cylindrical bore through the connecting surface and intersecting a slotted recess, for receiving one of the lock mechanism cylindrical bodies. Further, means are provided which define a second bore in the padlock body which is aligned with the cylindrical body and intersecting the slotted recess for receiving the bolt.

A pin recess in the padlock body and intersecting the cylindrical bore provides a means for receiving the locking pin in the second protruding position in order to lock the locking mechanism within the padlock body with the bolt in the second bore.

A slot is provided in the cylindrical bore which provides means for receiving the locking pin in the first protruding position in order to both align the locking pin with the pin recess and prevent removal of the lock mechanism from the padlock body, as hereinabove mentioned.

Importantly, means are provided which define an opening in the padlock body back side for enabling depression of the spring biased locking pin into the lock mechanism cylindrical body in order to remove the lock mechanism from the padlock body and replace same with another lock mechanism. In this manner, a key lock mechanism of the present shackleless padlock system is easily changed through one movement of a screwdriver or the like, thus enabling a layman, with no locksmith experience, to replace the lock mechanism with one of a different key configuration, in a simple routine manner.

This is an important feature for users of a great number of shackleless padlock systems; for example, public storage facilities where such locks are provided by the lessor of the space and collected after use to be reissued to another renter. Thus, such a user need not employ the services of a locksmith in order to provide a shackleless padlock system with interchangeable keys and lock mechanisms.

BRIEF DESCRIPTION OF THE DRAWINGS

The advantages and features of the present invention will be better understood by the following description when considered in conjunction with the accompanying drawings in which:

FIG. 1 is a perspective view of a shackleless padlock system in accordance with the present invention, as it may be used in the field;

FIG. 2 is an exploded perspective view of the shackleless padlock system shown in FIG. 1;

FIG. 3 is a cross-sectional view of a shackleless padlock generally showing a padlock body and a lock mechanism with a bolt in an unlocked position;

DETAILED DESCRIPTION

Turning now to FIGS. 1 and 2, there is generally shown a shackleless padlock system 10, which generally includes a padlock body 12 and one or more lock mechanisms 14 as hereinafter described. Each one of the plurality of lock mechanisms 14 may be operable with a different key 16 (see FIG. 3).

Figure 4:
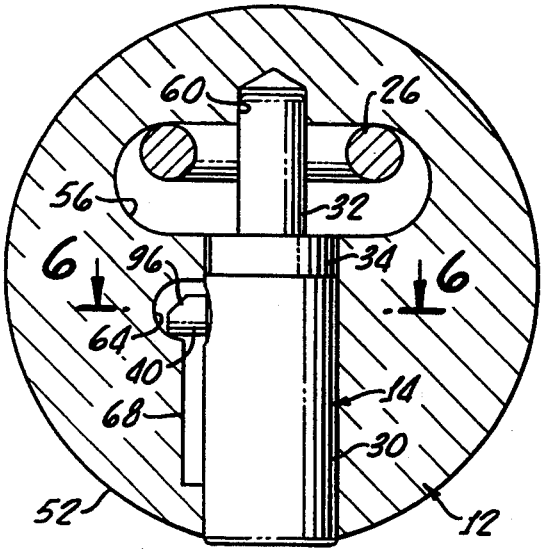
FIG. 4 is a cross-sectional view taken along the line 4—4 of FIG. 1 showing the lock mechanism with the bolt engaging a bore in the padlock body and a locking pin engaging a pin recess along with a slot for receiving the locking pin in order to align the locking pin within the recess.
Figure 5:
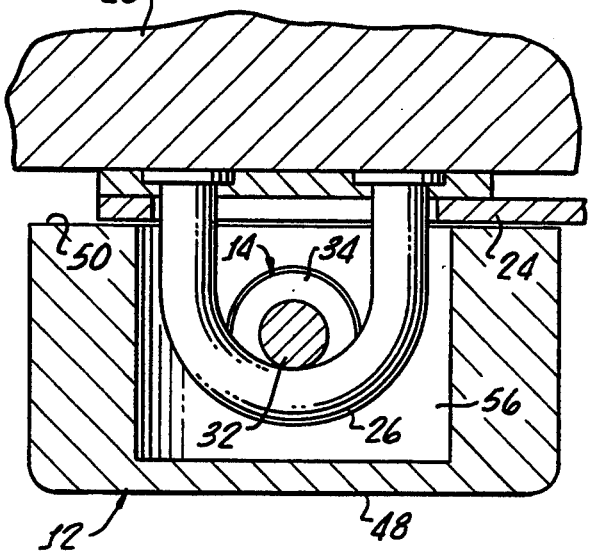
FIG. 5 is another cross-sectional view taken along the line 5—5 of FIG. 1 showing a bolt extending through a hasp member for locking thereof.

The shackleless padlock system 10 is suitable for securely locking adjoining panels or doors 20, 22 through the use of a conventional hasp 24 or the like, having a member 26 suitable for engagement as shown in FIGS. 4 and 5.

As shown in FIGS. 2–4, the lock mechanism 14 includes a cylindrical body 30 and a bolt 32 protruding from one end 34 of the cylindrical body 30 along with a key mechanism 38, as hereinafter described in greater detail, which provides means for causing a spring biased locking pin 40 to retractably protrude from the cylindrical body 14 from a first protruding position, as shown in FIG. 3, to a second protruding position, as shown in FIG. 4. An opening, or key slot, 44 disposed in another end 46 of the cylindrical body 14 provides means for accepting the key 16 and providing access for the key 16 to the operating mechanism 38.

The padlock body 12, which includes a front 48, a back 50, and a connecting surface 52, includes a slotted recess 56 in the back side 50 sized for accepting the hasp member 26. The cylindrical bore 58, through the connecting surface 52 and intersecting the slotted recess 56, provides means for receiving the lock mechanism cylindrical body 14 and further, a second bore 60 in the padlock body 12, aligned with the cylindrical bore 58 and intersecting the slotted means 56, provides a means for receiving the bolt 32 as most clearly shown in FIG. 4.

Figure 6:
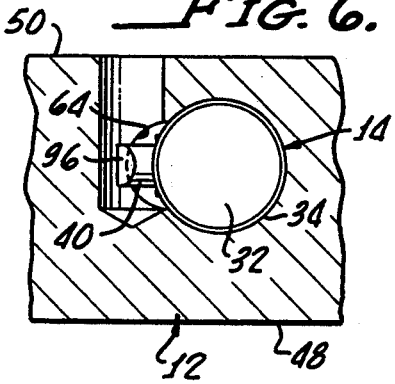
FIG. 6 is a cross-sectional view taken along the line 6—6 of FIG. 4 showing in greater detail engagement of the locking pin engaging the pin recess in the padlock body.

As shown in FIGS. 3, 4 and 6, a pin recess 64 intersecting the cylindrical bore 58 provides means for receiving the locking pin 40 in the second protruding position in order to lock the lock mechanism 14 in the padlock body 12 with the bolt 32 in the second bore 60 (see FIG. 4).

Importantly, a slot 68 in the cylindrical bore 58 provides a means for receiving the locking pin 40 in the first protruding position in order to align the locking pin 40 with the pin recess 64 and, in addition, prevent removal of the lock mechanism 14 from the padlock body 12. This feature enables any suitable lock mechanism 40 with a cylindrical body to be utilized with the padlock body 12 in accordance with the present invention. Further, this construction greatly simplifies manufacture of the scackless padlock system 10 and therefor greatly reduces the cost thereof.

An access hole 70 in the padlock back 50 and aligned with the pin recess 64 may be provided for insertion of a small screwdriver, or the like (not shown), in order to depress the spring biased locking pin 40 into the lock mechanism cylindrical body 30 in order to remove the locking mechanism from the padlock body 12.

When the access hole 70 is utilized for depressing the locking pin 40, the cylindrical body 14 may be rotated by the key 16 as shown by an arrow 76 in order to maintain the locking pin 40 in a recessed position with the cylindrical body 30 as the lock mechanism 14 is withdrawn from the body as indicated by the arrow 78.

Alternatively, a second hole 82 may be provided for enabling depression of the locking pin 40 in order to remove the lock mechanism 14. The second hole, or opening, 82 communicates with the slot 68 and is utilized to depress the locking pin 40 and the lock mechanism 30 may be removed from the body 12 in the direction of arrow 78 without rotation of the lock mechanism. It should be appreciated that while both openings 70, 82 may be provided, it is preferable that only one opening be made in the back 50 of the padlock mechanism in order to conserve manufacturing costs.

As hereinabove noted, any lock mechanism 14 having a spring biased locking pin is suitable for use in the present invention. In particular, the lock mechanism shown in U.S. Pat. No. 4,838,055 may be incorporated as a component of the present invention. For the purpose of describing such mechanism, the specification and drawings of U.S. Pat. No. 4,838,055 are incorporated herewith by this specific reference thereto.

Figure 7:
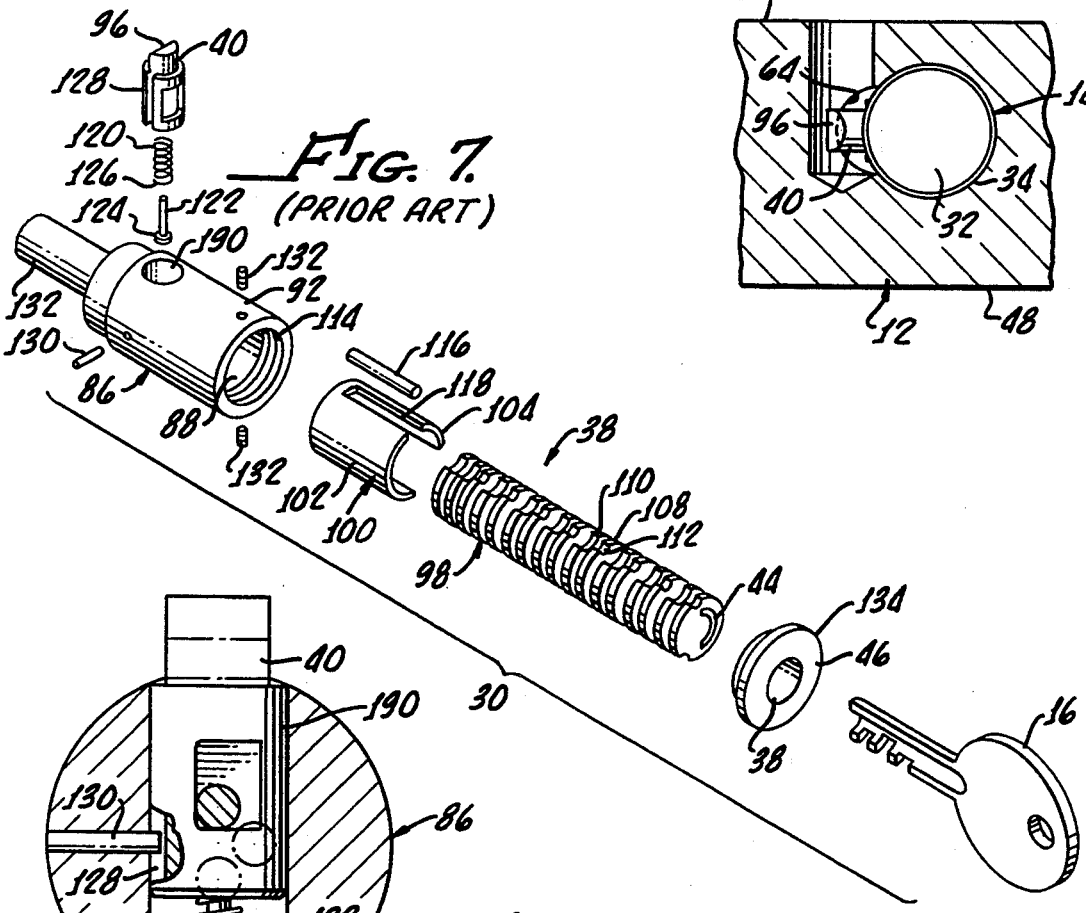
FIG. 7. (PRIOR ART)
FIG. 7 is an exploded view of the locking mechanism.
Figure 8:
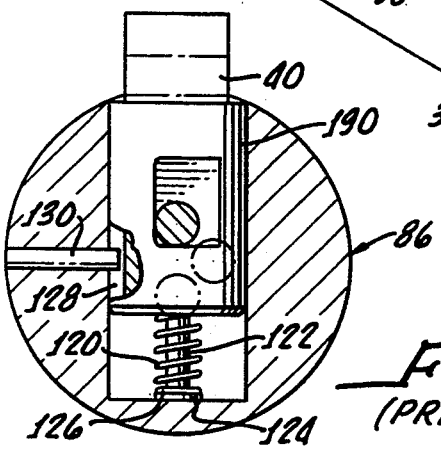
FIG. 8. (PRIOR ART)
FIG. 8 is a cross-sectional view of the locking mechanism showing in particular two protruding positions of the locking pin from a locking mechanism cylindrical body.

FIGS. 7 and 8 illustrate the general structure of the mechanism 30. The lock mechanism 30 generally includes a cylindrical case 86 having a cylindrical cavity 88 with a transverse bore 90 extending through a case wall 92 for slidably supporting the locking pin 40. A ramp surface 96 is provided on the locking pin 40 for causing the spring biased locking pin 40 to depress into the lock mechanism cylindrical body 30 as the cylindrical body 30 is inserted into the padlock body cylindrical bore 58.

Key operated tumblers 98 are disposed within a hollow carrier 100 which includes two cylindrical segmental walls 102, 104.

The tumblers 98 include a plurality of tumbler disks 108 and spacer disks 110, each tumbler includes a peripheral notch 112 and a key slot 44.

The case 86 includes a groove 114 and elongate bar 116 is normally disposed partly within the groove 114 and partly within a groove 118 formed in the carrier 100. When the key 16 is operated to turn the tumbler disks 108, the notches 112 move into registry with the groove 118 and the bar 116 shifts downwardly out of the groove 114 into a position disposed partly within the groove 118 and partly within the notches 112. Further rotation of the key 16 causes the carrier 100 and the disks 108 to rotate as a unit. Accordingly, the bar 116 acts as a drive bar to transmit the drive force from the disks 108 to the carrier 100.

A spring 120 biases the locking pin 40 which is stabilized by a rod 122 having a flange 124 for underlying the end convolution 126 of the spring 120 to retain the rod 122 in a desired position effective for spring stabilization.

An axial groove 128, locking pin 40 and a guide pin 130 extending through the case wall 92 prevent the locking pin 40 from rotating. Set screws 132 retain an end plug 134 in the case 86.

While the key 16 and mechanism 38, as hereinabove described, move the locking pin 40 from a first protruding position, indicated by broken line in FIG. 8, to a second protruding position, indicated by solid line in FIG. 8, the spring 120 enables further depression, as hereinabove described, of the locking pin to within the cylindrical body 30.

Although there has been hereinabove described a specific shackleless padlock system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A shackleless padlock for locking hasp members, said shackleless padlock comprising:

a lock mechanism having a cylindrical body and a bolt protruding from one end thereof and key operated means, disposed within said cylindrical body for causing a spring biased locking pin to retractably protrude from said cylindrical body from a first protruding position to a second protruding position, and means, defining an opening in another end of said cylindrical body, for accepting a key and for providing access for the key to the key operated means;

a padlock body having front and back sides subtending a connecting surface, means defining a slotted recess in the back side, for receiving a hasp member, means, defining a cylindrical bore through said connection surface intersecting said slotted recess, for receiving said lock mechanism cylindrical body and means, defining a second bore in the padlock body aligned with the cylindrical bore and intersecting said slotted recess, for receiving said bolt;

means, defining a pin recess in the padlock body intersecting the cylindrical bore, for receiving the locking pin in the second protruding position in order to lock the lock mechanism with the padlock body with the bolt in the second bore;

means, defining a slot in the cylindrical bore, for receiving the locking pin in the first protruding position in order to align the locking pin with the pin recess and prevent removal of the lock mechanism from the padlock body; and means, defining openings in the padlock body back side, for enabling depression of the spring biased locking pin into the lock mechanism cylindrical body in order to remove the lock mechanism from the padlock body when the locking pin is received in the pin recess and when the locking pin is received in the cylindrical bore slot.

2. The shackleless padlock according to claim 1 wherein said spring biased locking pin protrudes at a right angle with respect to the cylindrical body.

3. The shackleless padlock according to claim 2 wherein said spring biased locking pin comprises means, defining a ramp surface on a protruding end thereof, for causing the locking pin to depress into the lock mechanism cylindrical body as the cylindrical body is inserted into the padlock body cylindrical bore.

4. The shackleless padlock according to claim 3 wherein the slot in the padlock body cylindrical bore intersects the pin recess.

5. The shackleless padlock according to claim 4 wherein the padlock body opening, enabling depression of the locking pin, intersects the slot at a spaced apart relationship with the pin recess.

6. The shackleless padlock according to claim 4 wherein the padlock body opening, enabling depression of the locking pin, intersects the pin recess.

7. A shackleless padlock system for locking hasp members, said shackleless padlock system comprising:

a plurality of lock mechanisms each having a cylindrical body and a bolt protruding from one end thereof and key operated means, disposed within each said cylindrical body for causing a spring biased locking pin to retractably protrude from each said cylindrical body from a first protruding position to a second protruding position, and means, defining an opening in another end of each said cylindrical body, for accepting a key and for providing access for the key to the key operated means, each one of said plurality of lock mechanisms being operable with a different key;

a padlock body having front and back sides subtending a connecting surface; means, defining a slotted recess in the back side, for receiving a hasp member; means, defining a cylindrical bore through said connecting surface intersecting said slotted recess, for receiving any one of said plurality of lock mechanism cylindrical body; and means, defining a second bore in the padlock body aligned with the cylindrical bore and intersecting said slotted recess, for receiving said bolt;

means, defining a pin recess in the padlock body intersecting the cylindrical bore, for receiving the locking pin in the second protruding position in order to lock the lock mechanism within the padlock body with the bolt in the second bore;

means, defining a slot in the cylindrical bore, for receiving the locking pin in the first protruding position in order to align the locking pin with the pin recess and prevent removal of the lock mechanism from the padlock body; and means, defining openings in the padlock body back side, for enabling depression of the spring biased locking pin into the lock mechanism cylindrical body in order to remove one of said plurality of lock mechanisms from the padlock body and replace same with another of said plurality of lock mechanisms, said openings enabling depression of the locking pin when the locking pin is received in the pin recess and when the locking pin is received in the cylindrical bore slot.

8. The shackleless padlock system according to claim 7 wherein said spring biased locking pin of each of said plurality of lock mechanisms protrudes at a right angle with respect to the cylindrical body of each of said plurality of lock mechanisms.

9. The shackleless padlock system according to claim 8 wherein said spring biased locking pin of each of said plurality of lock mechanisms comprises means, defining a ramp surface on a protruding end thereof, for causing the locking pin to depress into the lock mechanism cylindrical body as the cylindrical body is inserted into the padlock body cylindrical bore.

10. The shackleless padlock system according to claim 9 wherein the slot in the padlock body cylindrical bore intersects with the pin recess.

11. The shackleless padlock system according to claim 10 wherein the padlock body opening, enabling depression of the locking pin, intersects the slot at a spaced apart relationship with the pin recess.

12. The shackleless padlock system according to claim 10 wherein the padlock body opening, enabling depression of the locking pin, intersects the pin recess.

* * * * *